US006044240A

United States Patent [19]

Sagara et al.

[11] Patent Number: 6,044,240

[45] Date of Patent: Mar. 28, 2000

[54] TRANSVERSE TYPE IMAGE FORMING APPARATUS

[75] Inventors: Yasunori Sagara, Kasuga; Hisanobu Matsuzoe, Chikushino; Shinichi Kizu, Fukuoka; Masashi Ogawa; Yusuke Shiibara, both of Kasuga; Kouji Migita; Yukinori Hara, both of Fukuoka-ken; Kazuo Hakukawa, Fukuoka, all of Japan

[73] Assignee: Matsushita Electric Industrial Co., Ltd., Osaka, Japan

[21] Appl. No.: 09/050,988

[22] Filed: Mar. 31, 1998

[30] Foreign Application Priority Data

Apr. 11, 1997 [JP] Japan ..... 9-093499
May 19, 1997 [JP] Japan ..... 9-128226

[51] Int. Cl.[7] ..... G03G 15/00; G03G 15/16

[52] U.S. Cl. ..... 399/164; 399/297; 399/313

[58] Field of Search ..... 399/162, 164, 399/165, 297, 313, 318

[56] References Cited

U.S. PATENT DOCUMENTS

| | | | |
|---|---|---|---|
| 4,855,784 | 8/1989 | Bujese | 399/297 |
| 5,216,453 | 6/1993 | Itoh | 399/297 |
| 5,819,133 | 10/1998 | Matsuzoe et al. | 399/297 X |

FOREIGN PATENT DOCUMENTS

| | | |
|---|---|---|
| 63-278086 | 11/1988 | Japan . |
| 4-69254 | 3/1992 | Japan . |
| 8-314291 | 11/1996 | Japan . |

*Primary Examiner*—William J. Royer
*Attorney, Agent, or Firm*—Stevens, Davis, Miller & Mosher, L.L.P.

[57] ABSTRACT

A transverse-type image forming apparatus in which a toner image carried on an endless toner image carrying belt is transferred to a printing paper by a transfer facing roller provided inside the toner image carrying belt and caused to move along the printing paper. A transfer bias voltage is applied to a transfer plate, on which the printing paper is set, during the backward movement of, or during both the forward and backward movements of, the transfer facing roller, so as to cause the toner image to be electrostatically attracted to the printing paper. The uneven transfer of the toner image is reduced.

9 Claims, 3 Drawing Sheets

PRIOR ART

TRANSVERSE TYPE IMAGE FORMING APPARATUS

BACKGROUND OF THE INVENTION

1. Field of the Invention

This invention relates to an image forming apparatus such as an electrophotographic copying machine, a laser beam printer and the like, and more specifically to an image forming apparatus in which a toner image carried on an endless belt-like toner image carrying belt is transferred to a printing paper by means of a transfer facing roller provided inside the toner image carrying belt and caused to move along the printing paper.

1. Description of the Prior Art

Recently, as represented by laser beam printers, image forming apparatus employing a toner system have begun to widely spread that can form clear images with high resolution. Among such image forming apparatus employing a toner system, image forming apparatus of the type that a toner image carried on an endless toner image carrying belt is transferred to a printing paper by means of a transfer facing roller provided inside the toner image carrying belt and caused to move along the printing paper, are very suitable for the promotion of downsizing of the products from the viewpoint of the structures thereof.

As one structure out of them, description will be given below of a cross-transfer type image forming apparatus in which a toner image carrying belt caused to move in a direction perpendicular to the direction of conveyance of a printing paper is rubbed on the printing paper by means of a transfer facing roller so as to transfer a toner image little by little in each process.

FIG. 2 is a schematic view of a conventional cross-transfer type image forming apparatus, and FIG. 3 is a schematic perspective view of the conventional cross-transfer type image forming apparatus. In FIGS. 2 and 3, the reference numeral 1 denotes a toner image carrying member comprising a photosensitive belt; 2*a* and 2*b*, toner image carrying rollers; 3, a cleaning device; 4, a discharging device; 5, a charging device; 6, an exposing device; 7, a developing device; 8, a transfer facing roller; 9, a printing paper; and 10, a transfer plate, and the reference character A denotes a rotating direction of the toner image carrying member 1.

Arrangement, operation and so on of the image forming apparatus constructed as described above will be described.

As shown in FIG. 2, the charging device 5, the developing device 7, the cleaning device 3, the discharging device 4 and the like are disposed around the toner image carrying member 1 whose surface is coated with a layer of an organic photoconductive material. The exposing device for applying a laser beam is disposed above the toner image carrying member 1.

The toner image carrying member 1 is rotated in a direction meeting at right angles to the direction in which the printing paper 9 is conveyed so as to be electrically charged by the charging device 5 when passing by the latter. Then the exposing device 6 applies a laser beam 6*a* to selected portions of the thus-charged toner image carrying member 1 to thereby form an electrostatic latent image.

Toner 7*a* is rubbed on the portions of the toner image carrying member 1 corresponding to the thus-formed electrostatic latent image by means of a developing roller 7*b* so that a toner image 7*c* is caused to appear as a visible image successively on the toner image carrying member 1. Then, the transfer facing roller 8 is caused to move inside the toner image carrying member 1 in a direction perpendicular to the direction of conveyance of the printing paper 9 while pressing the toner image carrying member 1 against the printing paper 9. As a result, the toner image 7*c* is transferred to the printing paper 9 by the pressure produced between the transfer facing roller 8 and the transfer plate 10. Thereafter, the transfer facing roller 8 is returned to the stand-by position thereof following the same path reversely. In this way, the transfer facing roller is caused to move back and forth inside the toner image carrying member 1.

In the conventional cross-transfer type image forming apparatus described above, however, the toner image 7*c* on the toner image carrying member 1 is transferred to the printing paper 9 only by the pressure produced between the transfer facing roller 8 and the transfer plate 10 while the transfer facing roller 8 is moved in the direction perpendicular to the direction of conveyance of the printing paper 9, resulting in the problems that the toner may be partially left on the toner image carrying member 1 and that the toner transferred to the printing paper 9 may return to the toner image carrying member 1 again.

SUMMARY OF THE INVENTION

It is an object of the present invention to provide an image forming apparatus which is capable of performing a high quality printing owing to the stable transfer.

In order to achieve this end, according to the present invention, there is provided an image forming apparatus which comprises an endless toner image carrying belt stretched in a direction perpendicular to or parallel with the direction of conveyance of a printing paper by means of a plurality of rollers, and a transfer facing roller provided inside the toner image carrying belt and caused to move along the printing paper for transferring a toner image carried on the toner image carrying belt to the printing paper in a direction perpendicular to or parallel with the direction of conveyance of the printing paper, wherein when the toner image is transferred to the printing paper by a stroke of reciprocating movement of the transfer facing roller, an electric field causing the toner image to be transferred to the printing paper is exerted on the toner image during the backward movement of the transfer facing roller to its stand-by position or during both the forward and backward movements thereof.

With the construction described above, the toner can be prevented from being left on the toner image carrying belt, and the toner image transferred to the printing paper can be prevented from returning to the toner image carrying belt again.

DESCRIPTION OF THE PREFERRED EMBODIMENT

Figure 1:
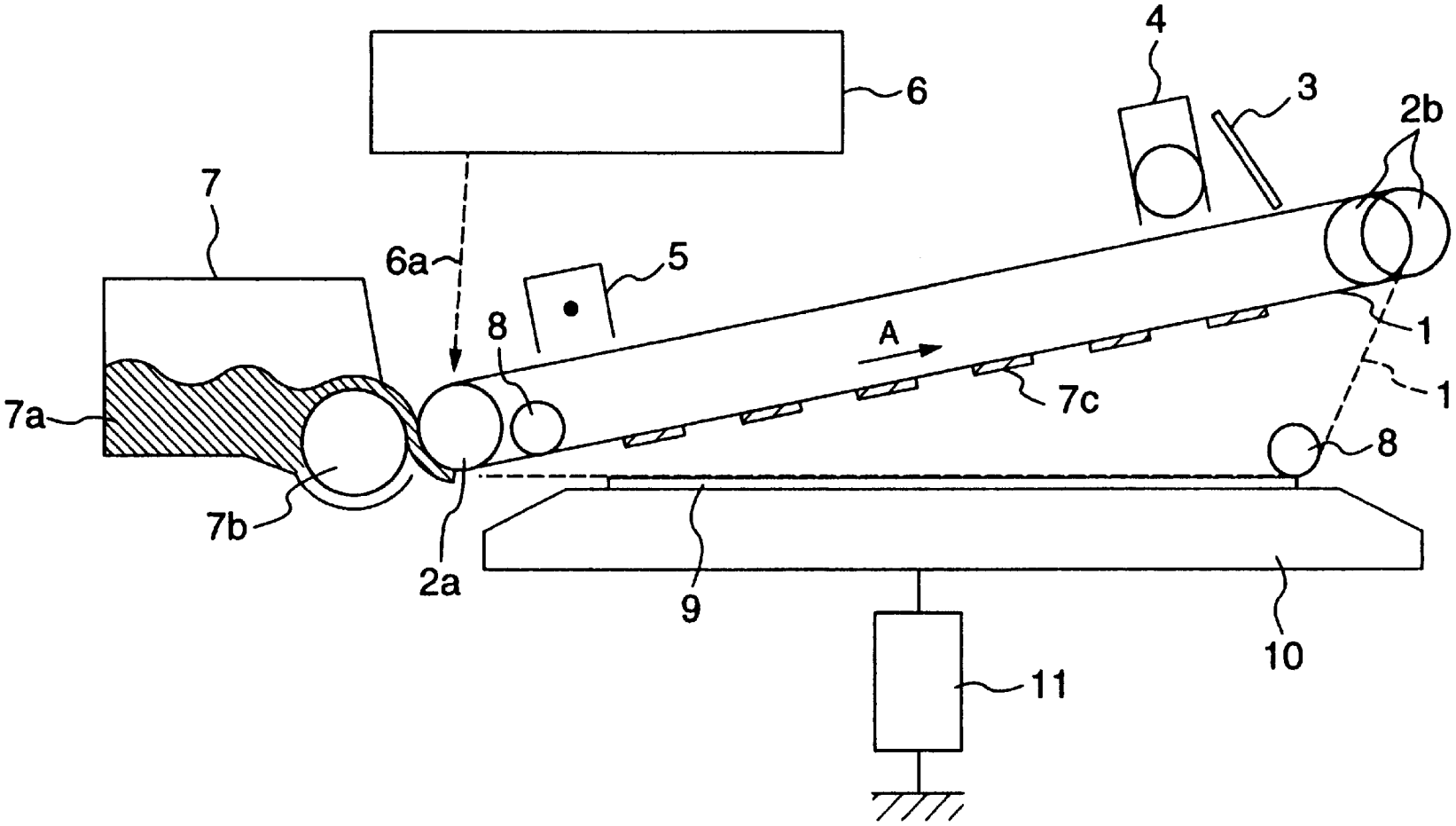
FIG. 1 is a schematic view of a cross-transfer type image forming apparatus according to an embodiment of the present invention.
Figure 2:
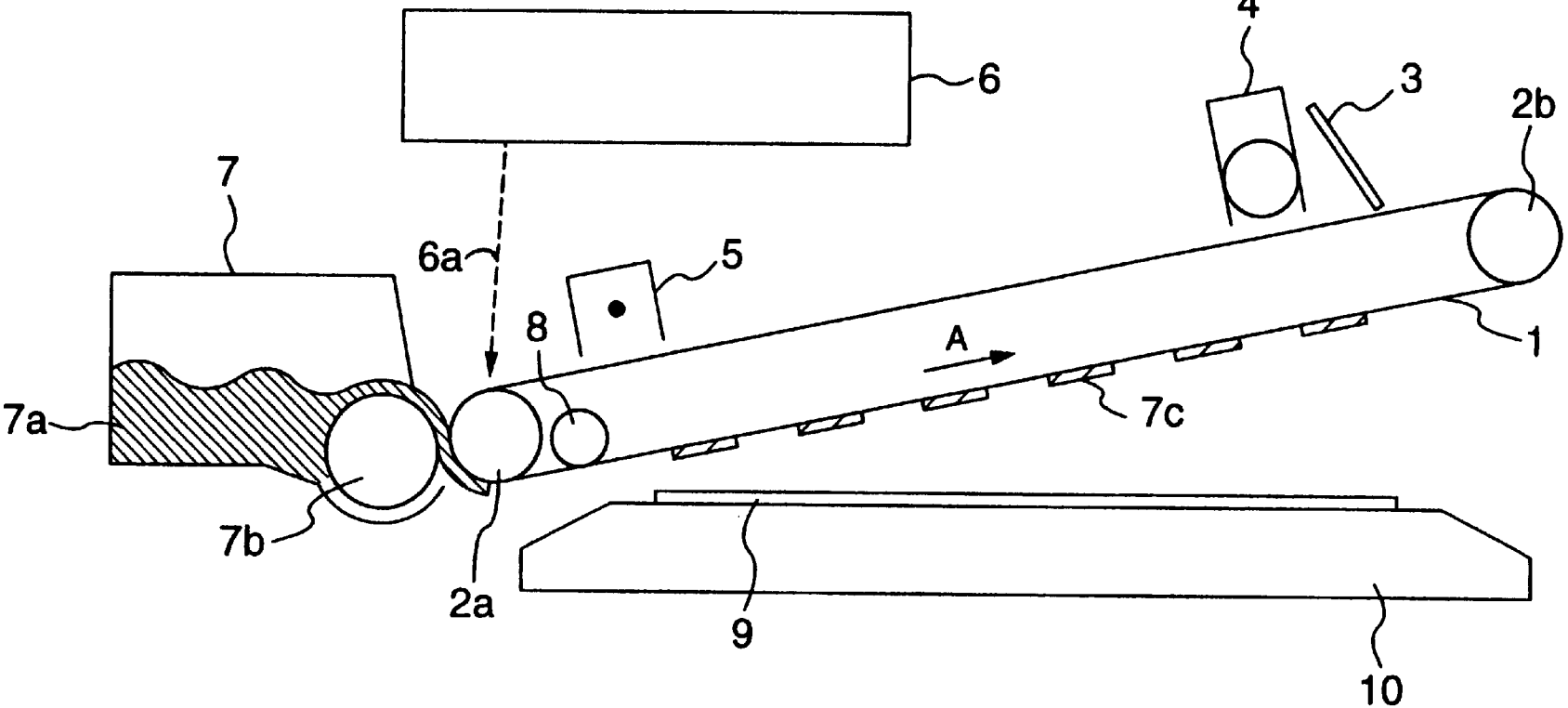
FIG.2 PRIOR ART
FIG. 2 is a schematic view of a conventional cross-transfer type image forming apparatus.
Figure 3:
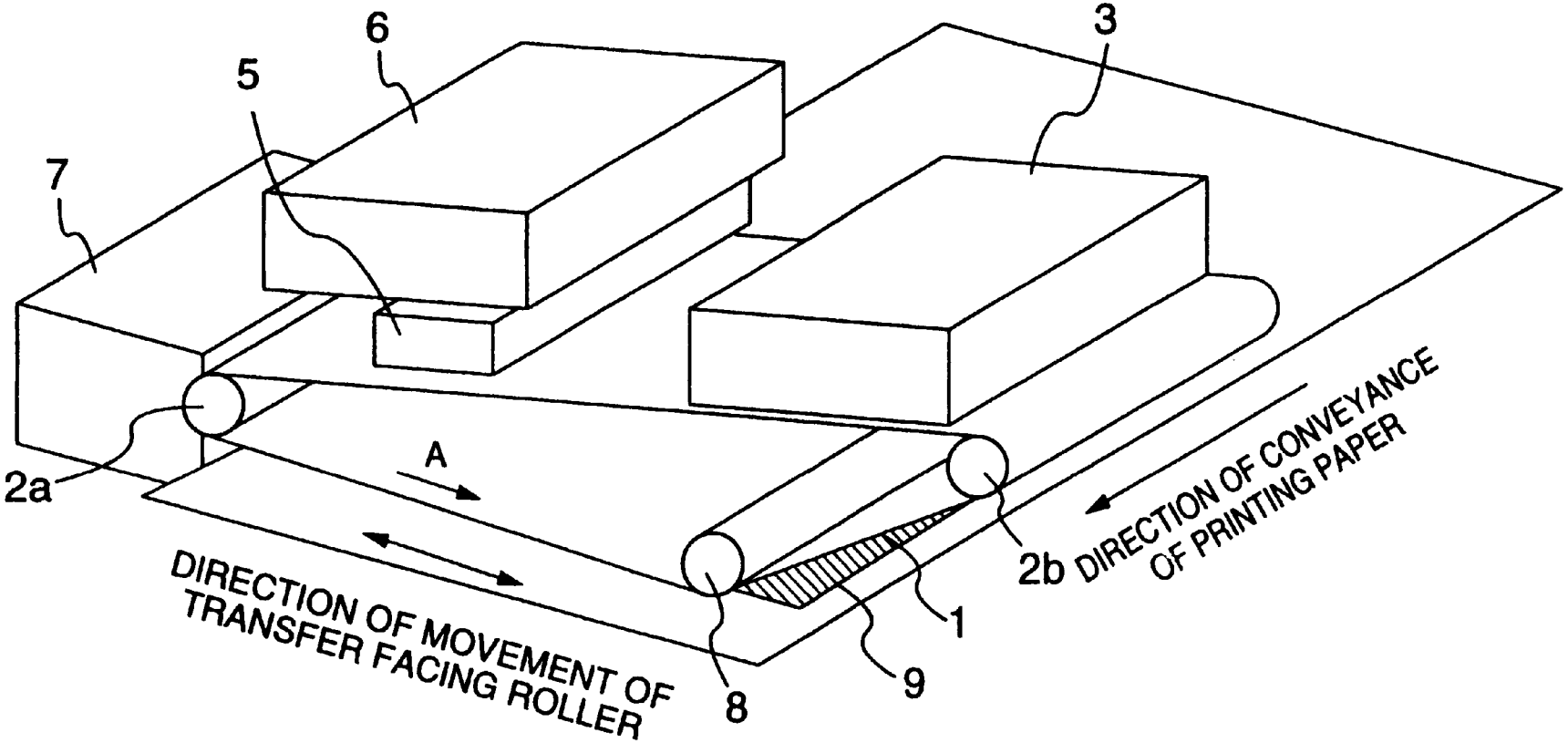
FIG. 3 is a schematic perspective view of a conventional cross-transfer type image forming apparatus.

FIG. 1 is a schematic view of a cross-transfer type image forming apparatus according to a preferred embodiment of the present invention. In FIG. 1, a toner image carrying member 1 is rotated in a direction meeting at right angles to a direction, in which a printing paper 9 is conveyed, so as to permit a laser beam 6*a* emitted from an exposing device 6 to be applied onto selected portions thereof having been electrically charged by a charging device 5 to thereby form an electrostatic latent image. Then, toner 7*a* is rubbed on those portions of the toner image carrying member 1 corresponding to the thus-formed electrostatic latent image by a developing device 7 to thereby form a toner image 7*c*.

At this time, since the toner image carrying member 1 is negatively charged, the toner image 7*c* is negatively charged as well. After the developing process is finished, a transfer facing roller 8 is caused to move in a direction perpendicular to the direction of conveyance of the printing paper 9 for the purpose of transferring the toner image 7*c* formed on the toner image carrying member 1 to the printing paper 9. However, the printing paper 9 is allowed to be conveyed only when the transfer facing roller 8 is in its stand-by position (i.e. in the position laterally of a toner image carrying roller 2*a* in FIG. 1), and therefore the transfer facing roller 8 must be returned to the stand-by position thereof at the instant when the transfer process is completed. For this reason, the transfer facing roller 8 has to be moved as far as an end portion of the printing paper 9 (i.e. the right end of the printing paper 9 in FIG. 1) and then returned to its stand-by position in such a manner as to be moved back and forth inside the toner image carrying member 1.

For the purpose of performing the transfer process, when the transfer facing roller 8 is caused to move inside the toner image carrying member 1 in the direction perpendicular to the direction of conveyance of the printing paper 9, the toner image 7*c* is transferred to the printing paper 9 by the pressure produced between the transfer facing roller 8 and a transfer plate 10.

However, in such transfer operation, part of the toner may be left on the toner image carrying member 1 when the transfer facing roller 8 is moved forward, or the toner transferred to the printing paper 9 may return to the toner image carrying member 1 again when the roller 8 is moved backward.

To cope with this, while the transfer facing roller 8 is moved backward to the stand-by position thereof, a bias voltage of the polarity opposite to that of the charged toner is applied to the transfer plate 10 under the printing paper 9 by means of a transfer bias voltage source 11 so as to cause the toner image 7*c* to be electrically attracted to the printing paper 9.

In both cases where the bias voltage at this time is lower than +300 V and where it is higher than +1200 V, the efficiency of transfer tends to be deteriorated. Therefore, each of these bias voltages is not desirable but bias voltages ranging from +300 V to +1200 V are most desirable.

Attributed to the attraction effect described above, the toner can be prevented from being partially left on the toner image carrying member 1, and the toner transferred to the printing paper 9 can be prevented from returning to the toner image carrying member 1 again.

It may be contemplated as well that a bias voltage of the polarity opposite to that of the charged toner is applied to the transfer plate 10 only when the transfer facing roller 8 is moved forward. In this case, the toner can be prevented from being left on the toner image carrying member 1, but still there is a possibility that the toner on the printing paper may return to the toner image carrying member during the backward movement of the transfer facing roller. Accordingly, in the present invention, the bias voltage of the polarity opposite to that of the charged toner is applied to the transfer plate 10 only when the transfer facing roller is moved backward.

Then, as soon as the transfer facing roller 8 is returned to the stand-by position thereof after a stroke of reciprocating movement, application of the bias voltage to the transfer plate 10 is stopped to allow the printing paper 9 to be conveyed by an amount equal to the width of the developing device 7, followed by the succeeding developing process.

As described above, in the present embodiment, a bias voltage of the polarity opposite to that of the charged toner is applied to the transfer plate 10 under the printing paper 9 while the transfer facing roller 8 is moved backward in the transfer process, and therefore the toner can be prevented from being partially left on the toner image carrying member 1, and the toner transferred to the printing paper 9 can be prevented from returning to the toner image carrying member 1 again.

As described in the above, according to the image forming apparatus of the present invention, when the toner is transferred to the printing paper 9 by the reciprocating movement of the transfer facing roller 8, a bias voltage of the polarity opposite to that of the charged toner is applied to the transfer plate 10 while the transfer facing roller 8 is moved backward to the stand-by position thereof so as to cause the toner to be electrically attracted to the printing paper 9. Therefore, the toner can be prevented from being left on the toner image carrying member 1, and the toner transferred to the printing paper 9 can be prevented from returning to the toner image carrying member 1 again, with the result that it is possible to perform a high quality printing owing to the stable transfer.

Further, if a transfer bias voltage is applied to the transfer plate 10 by means of the transfer bias voltage source 11 during both the forward and backward movements of the transfer facing roller 8, the toner image 7*c* can be prevented in the forward movement of the transfer facing roller 8 from failing to be transferred to the printing paper 9 to be left on the toner image carrying member 1, while the toner image 7*c* once transferred to the printing paper 9 can be prevented in the backward movement of the transfer facing roller 8 from being retransferred to the toner image carrying member 1. In consequence, it is possible to perform a high quality printing owing to the stable transfer with higher efficiency of transfer.

Incidentally, in the present embodiment, description has been made about the cross-transfer type image forming apparatus, and however the same effects can also be obtained by another type of image forming apparatus in which the toner image carrying member 1 is rotated in a direction parallel with the direction of conveyance of the printing paper 9 and the transfer facing roller 8 is moved in a direction parallel with the direction of conveyance of the printing paper 9.

What is claimed is:

1. An image forming apparatus comprising:

an endless toner image carrying belt stretched by a plurality of rollers; and a transfer facing roller provided inside the toner image carrying belt and caused to move back and forth along a printing paper for transferring a toner image carried on the toner image carrying belt to the printing paper, wherein:

when the toner image is transferred to the printing paper by the transfer facing roller, an electric field acts upon the toner image to hold the toner image to the printing paper during backward movement of the transfer facing roller to a stand-by position.

2. An image forming apparatus comprising:

an endless toner image carrying belt stretched by a plurality of rollers; and a transfer facing roller provided inside the toner image carrying belt and caused to move back and forth along a printing paper for transferring a toner image carried on the toner image carrying belt to the printing paper, wherein:

when the toner image is transferred to the printing paper by the transfer facing roller, an electric field acts upon the toner image to hold the toner image to the printing paper during only the backward movement of the transfer facing roller to a stand-by position.

3. An image forming apparatus comprising:

an endless toner image carrying belt stretched by a plurality of rollers; and a transfer facing roller provided inside the toner image carrying belt and caused to move back and forth along a printing paper for transferring a toner image carried on the toner image carrying belt to the printing paper, wherein:

when the toner image is transferred to the printing paper by the transfer facing roller, an electric field acts upon the toner image to hold the toner image to the printing paper during both the forward and backward movements of the transfer facing roller in a moving direction.

4. An image forming apparatus comprising:

an endless toner image carrying belt stretched by a plurality of rollers;

a transfer facing roller provided inside the toner image carrying belt and caused to move back and forth along a printing paper for transferring a toner image carried on the toner image carrying belt to the printing paper;

a transfer plate on which the printing paper is set; and a transfer bias voltage source for, when the toner image is transferred to the printing paper by means of the transfer facing roller, applying a transfer bias voltage, causing the toner image to be transferred to the printing paper, to said transfer plate during only the backward movement of the transfer facing roller to its stand-by position.

5. An image forming apparatus according to claim 4, wherein said transfer bias voltage is in the range of +300 to +1200 V.

6. An image forming apparatus comprising:

an endless toner image carrying belt stretched by a plurality of rollers;

a transfer facing roller provided inside the toner image carrying belt and caused to move back and forth along a printing paper for transferring a toner image carried on the toner image carrying belt to the printing paper;

a transfer plate on which the printing paper is set; and a transfer bias voltage source for, when the toner image is transferred to the printing paper by means of the transfer facing roller, applying a transfer bias voltage, causing the toner image to be transferred to the printing paper, to said transfer plate during both the forward and backward movements of the transfer facing roller in its moving direction.

7. An image forming apparatus according to claim 6, wherein said transfer bias voltage is in the range of +300 to +1200 V.

8. An image forming apparatus comprising:

an endless toner image carrying belt stretched in a direction perpendicular to a direction of conveyance of a printing paper by means of a plurality of rollers;

a transfer facing roller provided inside the toner image carrying belt and caused to move back and forth along the printing paper for transferring a toner image carried on the toner image carrying belt to the printing paper in the direction perpendicular to the direction of conveyance of the printing paper;

a transfer plate on which the printing paper is set; and a transfer bias voltage source for, when the toner image is transferred to the printing paper by means of the transfer facing roller, applying a transfer bias voltage, causing the toner image to be transferred to the printing paper, to said transfer plate during only the backward movement of the transfer facing roller to its stand-by position.

9. An image forming apparatus comprising:

an endless toner image carrying belt stretched in a direction perpendicular to a direction of conveyance of a printing paper by means of a plurality of rollers;

a transfer facing roller provided inside the toner image carrying belt and caused to move back and forth along the printing paper for transferring a toner image carried on the toner image carrying belt to the printing paper in the direction perpendicular to the direction of conveyance of the printing paper;

a transfer plate on which the printing paper is set; and a transfer bias voltage source for, when the toner image is transferred to the printing paper by means of the transfer facing roller, applying a transfer bias voltage, causing the toner image to be transferred to the printing paper, to said transfer plate during both the forward and backward movements of the transfer facing roller in its moving direction.

* * * * *